US006355188B1

(12) United States Patent
Tani et al.

(10) Patent No.: US 6,355,188 B1
(45) **Date of Patent: *Mar. 12, 2002**

(54) RESISTIVE MATERIAL, AND RESISTIVE PASTE AND RESISTOR COMPRISING THE MATERIAL

(75) Inventors: Hiroji Tani, Nagaokakyo; Keisuke Nagata, Kyoto, both of (JP)

(73) Assignee: Murata Manufacturing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 817 days.

(21) Appl. No.: 08/578,106

(22) Filed: Dec. 26, 1995

(30) Foreign Application Priority Data

Dec. 30, 1994 (JP) ..... 6-339878

(51) Int. Cl.[7] ..... H01B 1/02; B05D 5/12

(52) U.S. Cl. ..... 252/519.13; 252/514; 29/610.1; 427/101; 427/126.2; 427/126.3; 427/376.2

(58) Field of Search ..... 427/101, 103, 427/126.2, 126.3, 126.5, 376.2, 376.7, 383.5; 501/32; 252/514, 518, 521; 29/610.1

(56) References Cited

U.S. PATENT DOCUMENTS

| | | | | | |
|---|---|---|---|---|---|
| 4,536,328 | A | * | 8/1985 | Hankey | 252/518 |
| 4,814,107 | A | * | 3/1989 | Steinberg | 252/512 |
| 4,865,877 | A | * | 9/1989 | Yamaguchi et al. | 427/98 |
| 5,036,027 | A | | 7/1991 | Watanabe et al. | 501/96 |
| 5,264,156 | A | * | 11/1993 | Gora et al. | 252/518 |
| 5,345,212 | A | * | 9/1994 | Brown | 338/20 |
| 5,470,668 | A | * | 11/1995 | Wu et al. | 428/688 |

FOREIGN PATENT DOCUMENTS

| | | |
|---|---|---|
| JP | 5550361 | 12/1980 |
| JP | 58-21402 | 4/1983 |
| JP | 59-6481 | 2/1984 |
| JP | 63-224301 | 9/1988 |
| JP | 2249203 | 10/1990 |
| JP | 4125901 | 4/1992 |

OTHER PUBLICATIONS

Materials Research Society Symposium Proceedings, San Francisco, CA, vol. 341, Apr. 5–7, 1994, pp. 229–240, XP000608066 EOM C B et al., "Epitaxial Thin Films and Heterostructures of Various Isotropic Metallic Oxides for Device Application".

* cited by examiner

*Primary Examiner*—Brian K. Talbot
(74) *Attorney, Agent, or Firm*—Ostrolenk, Faber, Gerb & Soffen

(57) ABSTRACT

An organic vehicle is added to and kneaded with a solid component comprising from 5 to 65% by weight of a resistance material having a composition of $Ca_xSr_{1-x}RuO_3$ (x is from 0.25 to 0.75 moles) and from 35 to 95% by weight of a non-reducible glass frit to obtain a resistive paste. A substrate is coated with the resistive paste and fired to produce a resistor. The resistive paste can be fired in a neutral or reducing atmosphere. The resistor has any desired resistance value within a broad range including even high resistance values of higher than 10 KΩ, and the reproducibility of the resistor with a desired resistance value is good.

6 Claims, 1 Drawing Sheet

RESISTIVE MATERIAL, AND RESISTIVE PASTE AND RESISTOR COMPRISING THE MATERIAL

BACKGROUND OF THE INVENTION

1. Field of the Invention:

The present invention relates to a resistive material, a resistive paste which can be fired in a neutral or reducing atmosphere, and a resistor to be formed by the use of the resistive paste.

2. Description of the Related Art

In general, a ceramic substrate comprising alumina, zirconia or the like has circuit patterns for electrodes, resistors, etc., in order that various electronic parts can be mounted thereon. Electrodes (electrode patterns) are generally formed on the substrate by screen-printing a noble metal paste comprising silver, a silver-palladium alloy or the like followed by firing the thus-printed paste in air.

However, since a noble metal paste such as that mentioned above is not only expensive but also problematic in its migration resistance, the tendency for such an expensive noble metal paste to be replaced by a base metal paste comprising, as the conductive component, copper, nickel, aluminum or the like has become accepted in this technical field. Such a base metal paste can be screen-printed on a substrate and then fired in a neutral or reducing atmosphere to give an inexpensive and good electrode pattern.

In this case, it is desirable that the resistive paste which is to form resistors (resistor patterns) on the substrate, by which the plural base electrodes as formed by firing the printed base metal paste are connected with each other, can also be fired in a neutral or reducing atmosphere.

Therefore, various resistive pastes that can be fired in a neutral or reducing atmosphere to form resistors (resistor patterns) have heretofore been proposed. Such resistive pastes includes, for example, resistive pastes comprising $LaB_6$ such as those described in Japanese Patent Publication Nos. 59-6481 and 58-21402, resistive pastes comprising $NbB_2$ such as those described in Japanese Patent Laid-Open No. 63-224301, resistive pastes comprising solid solutions of $Nb_xLa_{1-x}B_{6-4x}$ such as those described in Japanese Patent Laid-Open No. 2-249203, etc.

However, conventional resistive pastes such as those mentioned above are problematic in that, when they are desired to have a resistance value that is variable within a broad range by varying the mixing ratio of the resistive material consisting the paste to glass frit to be added thereto, even a slight variation in the amount of the glass frit in the paste often results in a rapid variation in the resistance value of the paste (that is, the resistance value of the paste greatly depends on the composition of the paste) and therefore the reproducibility of the desired resistance value of the paste is poor. Therefore, such conventional resistive pastes are still problematic in that they can be formed into practicable resistors having a resistance value only within a narrow range between 10 Ω/square and 10 KΩ/square.

Apart from the above, other resistive pastes comprising a resistive material of $RuO_2$, $SrRuO_3$, $CaRuO_3$ or the like have also been proposed. However, resistive pastes comprising $RuO_2$ are problematic in that, when they are fired in a neutral or reducing atmosphere, $RuO_2$ is reduced to Ru metal with the result that they cannot be formed into resistors. Resistive pastes comprising $SrRuO_3$ or $CaRuO_3$ are also problematic in that, if the proportion of glass frit to be therein is increased more than a certain degree, the resistance value of the pastes suddenly becomes too great and therefore the reproducibility of the desired resistance value of the pastes is extremely poor.

SUMMARY OF THE INVENTION

The present invention seeks to solve the above-mentioned problems in the prior art and to provide a resistive paste which can be fired in a neutral or reducing atmosphere to surely give resistors having any desired resistance values within a broad range including values of even greater than 10 KΩ, a resistive material which constitutes the resistive paste, and a resistor which can be formed by the use of the resistive paste and which can realize resistance values within a broad range while the reproducibility of the realizable resistance values is good.

The resistive material which the present invention provides so as to attain the above-mentioned object is characterized in that it has a composition of a general formula:

$$Ca_xSr_{1-x}RuO_3$$

wherein x is from 0.25 to 0.75 moles.

The resistive paste which the present invention also provides so as to attain the above-mentioned object is characterized in that it comprises a solid component consisting of from 5 to 65% by weight of the resistive material and from 35 to 95% by weight of a non-reducible glass frit and an organic vehicle.

The resistor which the present invention also provides so as to attain the above-mentioned object is characterized in that it is formed by coating the resistive paste on a substrate and then firing it thereon.

DETAILED DESCRIPTION OF THE INVENTION

Figure 1:
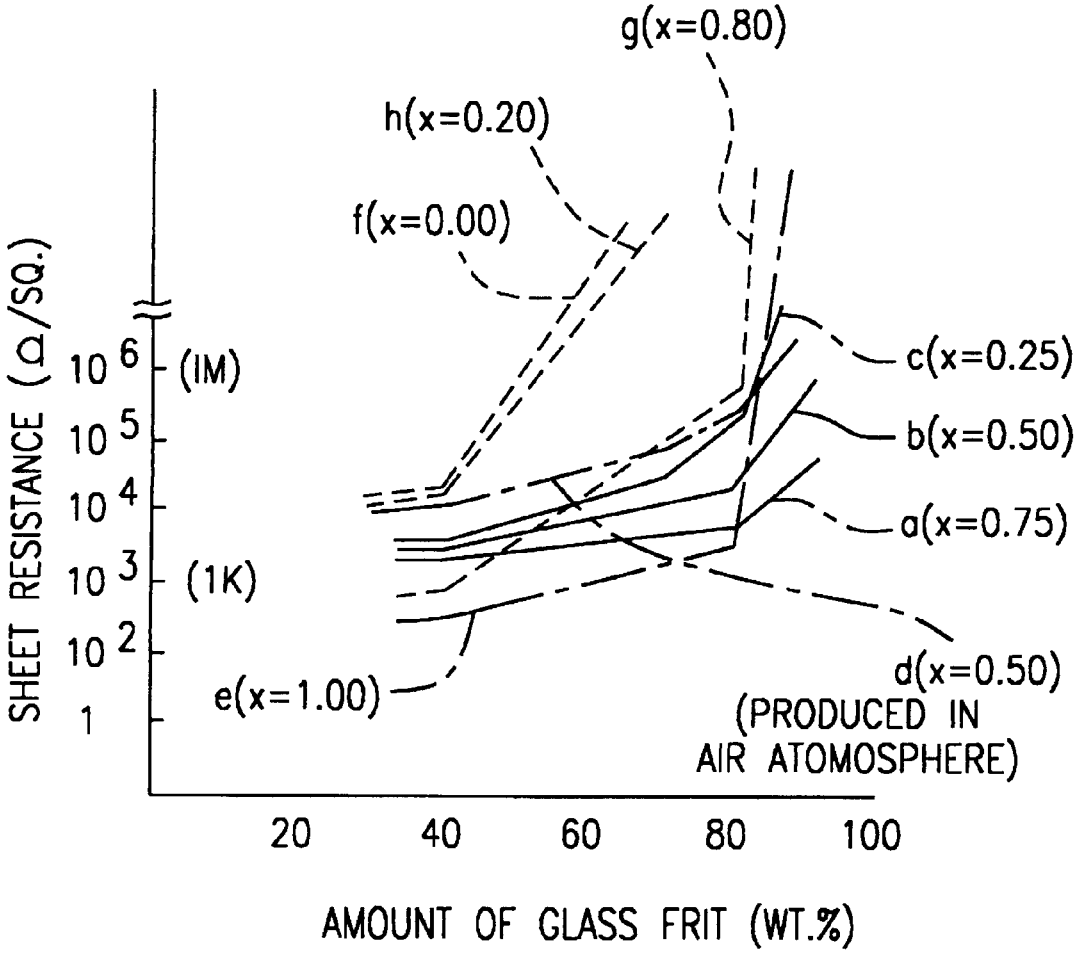
FIG. 1 is a graph showing the relationship between the sheet resistance value of the resistors as produced in the examples and the comparative examples mentioned hereinunder and the amount of the glass frit added to the resistive pastes from which the resistors were produced.

The resistive material of the present invention has a composition corresponding to the general formula:

$$Ca_xSr_{1-x}RuO_3$$

wherein x is from 0.25 to 0.75 moles.

The resistive paste of the present invention comprises a solid component consisting of from about 5 to 65% by weight of the resistive material and from about 35 to 95% by weight of a non-reducible glass frit and an organic vehicle.

One embodiment of the resistive paste is such that the non-reducible glass frit is a $B_2O_3$—$SiO_2$—BaO—CaO—$Nb_2O_5$ glass frit.

The resistor of the present invention is formed by coating the resistive paste on a substrate and then firing it thereon.

In the resistive material of the present invention, x falls between 0.25 moles and 0.75 moles. This is because if x is less than 0.25 moles, it is impossible to prevent the resistive material from having a too much increased resistance value when the glass frit content of the material is increased. On the other hand, if it is more than 0.75 moles, the increase in the resistance value of the material is also large. If so, therefore, the reproducibility of the desired resistance value of resistors comprising the resistive material is bad.

In the resistive paste of the present invention, the content of the resistive material in the solid component falls between 5% by weight and 65% by weight and that of the non-reducible glass frit in the same falls between 35% by weight and 95% by weight. This is because if the content of the non-reducible glass frit in the solid component is less than 35% by weight, the adhesiveness between the paste and the substrate is lowered, but if it is more than 95% by weight, the glass component flows out of the fired resistor to worsen the weldability of the fired resistor to electrodes.

To prepare the resistive paste of the present invention, an organic vehicle is added to and kneaded with a mixture (solid component) comprising the resistive material and the glass frit, so that the resulting resistive paste has the necessary printability. For this, employable are various organic vehicles which are generally used in ordinary resistive pastes for forming thick film resistors and which are prepared, for example, by dissolving an ethyl cellulose resin or acrylic resin in a terpene solvent such as α-terpineol or in a high-boiling point solvent such as kerosene, butyl carbitol, carbitol acetate or the like. If desired, additives may be added to the paste so as to make it thixotropic.

Next, the present invention is explained in more detail with reference to the following examples, which, however, are not intended to restrict the scope of the present invention.

EXAMPLES

First, a copper paste was screen-printed on an insulating substrate of alumina and fired in a nitrogen atmosphere to form electrodes thereon.

Next, as raw material substances for resistive materials, powdery $RuO_2$, $CaCO_3$ and $SrCO_3$ were weighed at predetermined proportions to have a composition of $Ca_xSr_{1-x}RuO_3$ (where x is a predetermined molar ratio) and wet-mixed in a pot mill. Then the resulting mixture was dried and subjected to milling of the resulting particles to have a predetermined mean particle size, and thereafter the particles were put into an alumina crucible and heated therein in a nitrogen atmosphere (reducing atmosphere) at a temperature falling between 900° C. and 1300° C. for 2 hours to produce the $Ca_xSr_{1-x}RuO_3$ composition. Next, this was ground in a solvent of acetone, using a shaking mill, into particles having a mean particle size of about 1 μm, and then dried. Thus, various resistive material samples were produced.

Other resistive material samples were also produced in the same manner as above, except that the nitrogen atmosphere was replaced by an air atmosphere.

Table 1 shows the various resistive material samples of $Ca_xSr_{1-x}RuO_3$ where x has a value indicated. In Table 1, the samples with asterisk (*) are comparative samples which are not within the scope of the present invention.

$B_2O_3$, $SiO_2$, BaO, CaO and $Nb_2O_5$ were mixed at a molar ratio of 36.05:31.67:18.02:9.26:5.00 and melted at a temperature falling between 1200° C. and 1350° C. to obtain a fused glass of $B_2)_3$—$SiO_2$—BaO—CaO—$Nb_2O_5$. This fused glass was rapidly cooled by putting it into pure water and then ground, using a shaking mill, into particles having a mean particle size of 5 μm. Thus was obtained a non-reducible glass frit sample.

The resistive material sample prepared above and the non-reducible glass frit sample were mixed at various ratios shown in Table 1, and an organic vehicle as obtained by diluting an acrylic resin with α-terpionel was added to and kneaded with the resulting mixture to obtain a resistive paste sample. The proportion of the solid component (mixture comprising the resistive material sample and the non-reducible glass frit sample) to the organic vehicle was 60:40 by weight.

TABLE 1

| Sample Number | x (mol) | Resistive Material (wt. %) | Glass Frit (wt. %) | Sheet Resistivity (Ω/square) | Atmosphere for Producing Resistive Material |
|---|---|---|---|---|---|
| *1 | 1.00 | 60 | 40 | 515 | nitrogen |
| *2 | 1.00 | 20 | 80 | 4.9 K | nitrogen |
| *3 | 1.00 | 10 | 90 | 1 G or more | nitrogen |
| *4 | 0.80 | 60 | 40 | 730 | nitrogen |
| *5 | 0.80 | 20 | 80 | 455 K | nitrogen |
| 6 | 0.75 | 60 | 40 | 2.1 K | nitrogen |
| 7 | 0.75 | 20 | 80 | 6.5 K | nitrogen |
| 8 | 0.75 | 10 | 90 | 50.1 K | nitrogen |
| 9 | 0.50 | 60 | 40 | 5.3 K | nitrogen |
| 10 | 0.50 | 20 | 80 | 33 K | nitrogen |
| 11 | 0.50 | 10 | 90 | 479 K | nitrogen |
| 12 | 0.25 | 60 | 40 | 6.5 K | nitrogen |
| 13 | 0.25 | 30 | 70 | 23 K | nitrogen |
| 14 | 0.25 | 20 | 80 | 256 K | nitrogen |
| *15 | 0.20 | 60 | 40 | 15 K | nitrogen |
| *16 | 0.20 | 20 | 80 | 1 G or more | nitrogen |
| *17 | 0.00 | 60 | 40 | 28 K | nitrogen |
| *18 | 0.00 | 20 | 80 | 1 G or more | nitrogen |
| 19 | 0.50 | 60 | 40 | 13 K | air |
| 20 | 0.50 | 30 | 70 | 73 K | air |
| 21 | 0.50 | 20 | 80 | 231 K | air |
| 22 | 0.50 | 10 | 90 | 4.3 M | air |

Next, the thus-obtained resistive paste was screen-printed between the electrodes that had been formed on the alumina substrate by firing a copper paste thereon. The resistor pattern thus printed was such that it partly covered the both terminal electrodes and had a length of 1.5 mm and a width of 1.5 mm. Next, the alumina substrate having the resistor pattern printed thereon was dried at 120° C. for 10 minutes and then fired in a tunnel furnace having a nitrogen atmosphere at a peak temperature of 900° C. for 10 minutes, whereby a resistor was formed on the substrate. Thus, resistor samples were prepared.

The sheet resistivity of each of the resistor samples prepared as above (sample Nos. 1 to 20) was measured. Table 1 above shows the data thus measured. The sheet resistivity was measured at 25° C., using a digital volt meter.

FIG. 1 shows the relationship between the sheet resistivity of the resistor samples as produced herein and the amount of the glass frit added to the resistive pastes from which the resistor samples were produced, in which the value of the molar ratio x was employed as the variable parameter. In FIG. 1, only the resistive materials for d (sample Nos. 19 to 22 with x=0.50) were produced in an air atmosphere, while the others were produced in a nitrogen atmosphere. In FIG. 1, the samples a, (sample Nos. 6 to 8 with x=0.75), b (sample Nos. 9 to 11 with x=0.50), c (sample Nos. 12 to 14 with x=0.25) and d (sample Nos. 19 to 22 with x=0.50) are within the scope of the present invention, while the samples e (sample Nos. 1 to 3 with x=1.00) and f (sample Nos. 17 and 18 with x=0.00) are comparative samples which are outside the scope of the present invention. In this, the samples g (sample Nos. 4 and 5 with x=0.80) and h (sample Nos. 15 and 16 with x=0.20) are also comparative samples which are outside the scope of the present invention, since the molar ratio x in these samples is not within the scope of the present invention.

From Table 1 and FIG. 1, it is known that the variation in the sheet resistivity of the resistor samples comprising any of the resistive materials having the composition that falls within the scope of the present invention (resistive materials of sample Nos. 6 to 14 produced in a nitrogen atmosphere and resistive materials of sample Nos. 19 to 22 produced in an air atmosphere), which depends on the variation in the composition of the resistive material, is smaller than that of the resistor samples not falling within the scope of the present invention (sample Nos. 1 to 5, and sample Nos. 15 to 18) or, that is, the composition dependence in the sheet resistivity of the former is lower than that of the latter.

Specifically, as is obvious from Table 1 and FIG. 1, the increase in the resistivity of the resistor samples with x=1.00 ($CaRuO_3$ of sample Nos. 1, 2, 3) is steep when the glass frit content of the resistance material therein is more than 80% by weight or, that is, the resistance value of these resistor samples greatly varies even if the mixing ratio of the resistive material to the glass frit therein is varied only slightly. Therefore, it is extremely difficult to make these resistor samples have a large resistance value of, for example, not lower than 5 KΩ and, in addition, the reproducibility of desired resistance values for these resistor samples is poor.

As is also known from Table 1 and FIG. 1, the resistor samples with x=0.00 ($SrRuO_3$ of sample Nos. 17 and 18) have a much increased resistance value of not lower than 1 GΩ, when the glass frit content of the resistive material therein is 80% by weight. Thus, the composition dependence in the resistance value of these samples with x=0.00 is extremely large and the resistance value of these samples greatly varies even when the mixing ratio of the resistive material to the glass frit therein is varied only slightly. Therefore, not only it is extremely difficult to make these samples have a desired resistance value but also it is almost impossible to expect high reproducibility of desired resistance values for these samples. In addition, it is known that the samples with x=0.80 (sample Nos. 4 and 5) and the samples with x=0.2 (sample Nos. 15 and 16) also have extremely large composition dependence in the resistance value.

As opposed to these comparative samples, the increase in the resistance value of the resistor samples comprising a fired resistor the resistive paste having a composition that falls within the scope of the present invention (sample Nos. 6 to 14, and sample Nos. 19 to 22) is gentle. According to the present invention, therefore, it is easy to realize resistors having a desired resistance value especially within a range of high resistance values, and it is possible to improve the reproducibility of the resistors having a desired resistance value.

By adjusting the value of x according to the invention or, that is, by suitably determining the ratio of Sr to Ca in the resistive material of the present invention that has a composition of a general formula $Ca_xSr_{1-x}RuO_3$ while by suitably determining the mixing ratio of the resistive material to the glass frit in the resistive paste of the present invention, it is possible to reliably produce resistors having any desired resistance value within a broad range, including even resistance values of higher than 10 KΩ (for example, from 1 KΩ to several MΩ).

As is known from Table 1 and FIG. 1, the resistor samples (sample Nos. 19 to 22 with x=0.50 for d) each comprising the resistive material as produced in an air atmosphere are apt to have a sheet resistance value on a higher level than the resistor samples (sample Nos. 9 to 11 with x=0.50 for b) having the same composition but having been produced in a nitrogen atmosphere. Therefore, according to the present invention, it is possible to desirably control the level of the sheet resistance value of the resistors to be produced, by suitably varying the atmosphere for the production of the resistance pastes to be in the resistors. In the present invention, it is meaningful to previously mix $CaRuO_3$ and $SrRuO_3$ in such a way that x in the resulting mixture, $Ca_xSr_{1-x}RuO_3$ may fall between 0.25 moles and 0.75 moles and thereafter to heat the mixture in a nitrogen or air atmosphere to thereby produce a resistance material comprising a solid solution of $Ca_xSr_{1-x}RuO_3$. The resistance material thus produced exhibits the particular effects of the present invention mentioned hereinabove.

In the above-mentioned examples, the glass frit used comprised $B_2O_3$, $SiO_2$, BaO, CaO and $Nb_2O_5$ at a molar ratio of 36.05:31.67:18.02:9.26:5.00, as the non-reducible glass frit. However, the components constituting the non-reducible glass frit to be employed in the present invention and the composition thereof are not limited to the above-mentioned ones. Needless-to-say, it is possible in the present invention to employ other non-reducible glass frits comprising other components and having other compositions than the illustrated ones.

The above-mentioned examples have demonstrated the formation of the resistors on the alumina substrate. However, the substrate on which the resistors of the present invention are formed is not limited to only such alumina substrate but the present invention is applicable to the formation of the resistors on other various substrates or bases made of other various materials.

The present invention is not limited to only the above-mentioned examples with respect to the other various aspects. For example, the proportion of the organic vehicle to the solid component comprising a resistance material and a non-reducible glass frit in the resistive paste of the present invention and the temperature conditions and the atmosphere conditions for firing the resistance paste can be variously changed or modified within the scope and the spirit of the present invention.

As has been described in detail hereinabove, the resistive paste of the present invention is formed by adding an organic vehicle to a solid component comprising from about 5 to 65% by weight of the resistance material of the present invention which has a composition of a general formula $Ca_xSr_{1-x}RuO_3$ (where x is from 0.25 moles to 0.75 moles) and from 35 to 95% by weight of a non-reducible glass frit, followed by kneading. By coating a substrate with the resistive paste of the present invention and firing in a neutral or reducing atmosphere, it is possible to reliably produce a resistor whose increase in the resistance value is gentler than that of conventional resistors. In addition, the reproducibility of the resistor of the present invention with such gentle increase in the resistance value is good.

Specifically, by using the resistive paste of the present invention which comprises a resistance material of $Ca_xSr_{1-}RuO_3$ (where x is from 0.25 moles to 0.75 moles) with varying the value x in the material and by suitably determining the mixing ratio of the resistance material to the glass frit in the paste, it is possible to produce a resistor having any desired resistance value within a broad range including even high resistance values of higher than 10 KΩ (for example, from 1 KΩ to several MΩ).

While the invention has been described in detail and with reference to specific embodiments thereof, it will be apparent to one skilled in the art that various changes and modifications can be made therein without departing from the spirit and scope thereof.

What is claimed is:

1. A resistive paste comprising an organic vehicle and a solid component comprising from about 5 to 65% by weight of resistance material having a composition of the formula:

$$Ca_xSr_{1-x}RuO_3$$

wherein x is from 0.25 to 0.75 moles and from about 35 to 95% by weight of a non-reducible glass frit, said paste having a resistivity after firing of at least 1,000 ohm/square.

2. The resistive paste as claimed in claim 1, wherein the non-reducible glass frit is a $B_2O_3$—$SiO_2$—BaO—CaO—$Nb_2O_5$ glass frit.

3. A resistor comprising a substrate with the resistive paste of claim 1 fired thereon.

4. A resistor comprising a substrate with the resistive paste of claim 2 fired thereon.

5. In a method of producing a resistor by applying a resistive paste to a substrate and firing, utilizing the resistive paste of claim 1 as said paste, and firing said paste in a reducing atmosphere.

6. In a method of producing a resistor by applying a resistive paste to a substrate and firing, utilizing the resistive paste to claim 2 as said paste, and firing said paste in a reducing atmosphere.

* * * * *